United States Patent [19]

Bernstein et al.

[11] 3,943,312

[45] Mar. 9, 1976

[54] FIRE HOSE NOZZLE COUPLER SWITCH

[75] Inventors: Joel L. Bernstein, Commack; Paul E. Kovach, Syosset, both of N.Y.

[73] Assignee: Grumman Aerospace Corporation, Bethpage, N.Y.

[22] Filed: Feb. 14, 1975

[21] Appl. No.: 550,041

[52] U.S. Cl.... 200/61.58 R; 200/61.86; 200/153 K; 200/157; 335/206

[51] Int. Cl.². H01H 3/16; H01H 9/06; H01H 21/16

[58] Field of Search..... 200/61.58 R, 61.6, 61.85, 200/61.86, 153 K, 157, 47; 335/205, 206, 207; 141/DIG. 1

[56] References Cited

UNITED STATES PATENTS

| | | | |
|---|---|---|---|
| 3,207,860 | 9/1965 | Korsgren, Jr. et al. | 200/153 K X |
| 3,316,369 | 4/1967 | Skinner | 200/61.58 R |
| 3,822,372 | 7/1974 | Coenen et al. | 335/206 X |
| 3,894,207 | 7/1975 | Jelley | 200/157 |

FOREIGN PATENTS OR APPLICATIONS

| | | | |
|---|---|---|---|
| 1,239,931 | 7/1971 | United Kingdom | 335/206 |

*Primary Examiner*—James R. Scott
*Attorney, Agent, or Firm*—Morgan, Finnegan, Pine, Foley & Lee

[57] ABSTRACT

An electrical switch assembly includes a housing adapted to be coupled to a hose and nozzle to form a fluid passage therebetween. The assembly has a pair of reed switches which provide signal input to circuitry and each switch may be activated by the manual rotation of a sleeve. The sleeve carries a magnet to actuate the switch and may be rotated in either direction from a centered position between the reed switches.

6 Claims, 4 Drawing Figures

FIRE HOSE NOZZLE COUPLER SWITCH

BACKGROUND OF THE INVENTION

The present invention relates to a system for controlling the flow of water in a fire hose and more particularly to a switch coupler to enable a hoseman to set and control the flow of water in his hose.

When a hoseman wished to have the flow in his hose changed, the hoseman would have to establish communication with the fireman positioned at the pumper. This communication has included voice commands, transmitter-receivers, gongs and telegraphic signals. None of these methods are completely satisfactory since, inter alia, they require a fireman at the pumper and introduction of human error or delay is not uncommon.

Commonly assigned, copending Nelson et al., U.S. patent application Ser. No. 550,044 filed contemporaneously herewith discloses an overall system for controlling the flow of water to fire hoses.

The present invention is directed to an electrical switch assembly which is used to generate signals for increasing and decreasing the flow of water to the fire hose. Briefly, it includes a housing which defines a flow channel and is coupled at one end to the hose and at the other end to the fire nozzle so that the switch assembly is manually accessible to the nozzleman. A longitudinally extending sleeve is rotatably mounted on the housing and carries a magnet, which when the sleeve is rotated, actuates a reed switch to provide a signal to a signal generator and transmitter circuitry within the coupler to provide a control signal for increasing and decreasing flow in the hose.

DETAILED DESCRIPTION OF A PREFERRED EMBODIMENT

Figure 1:
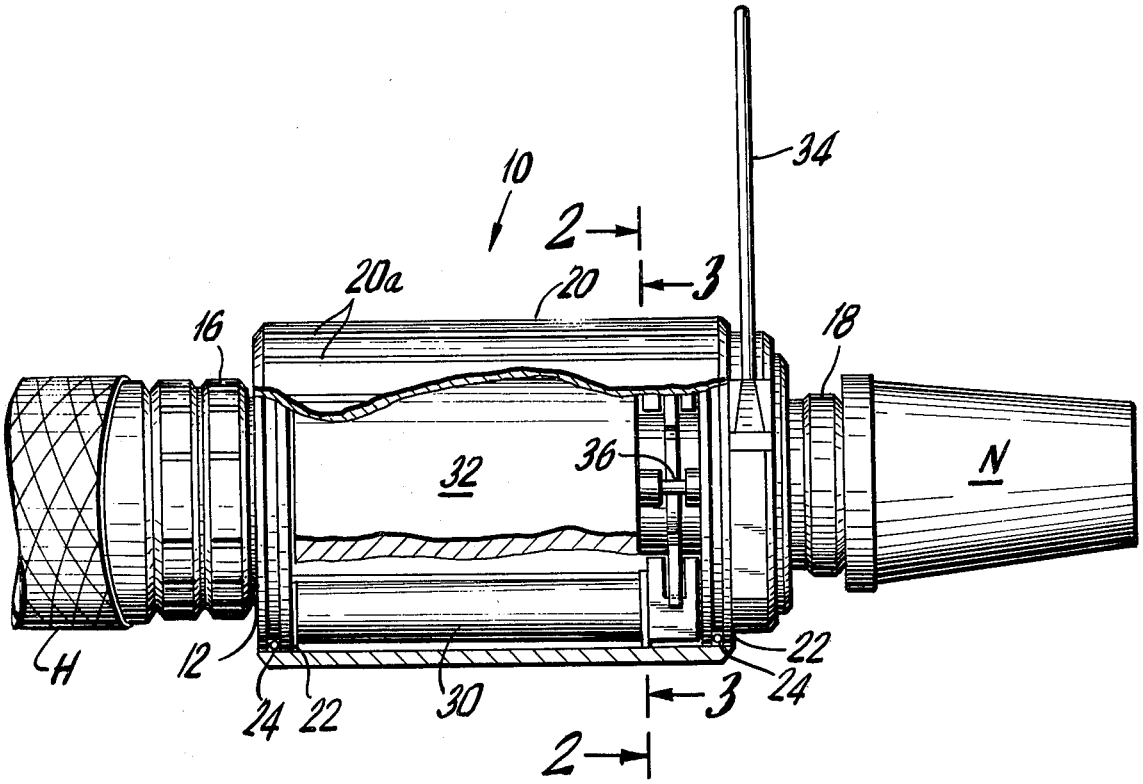
FIG. 1 is a top plan view with certain portions broken away illustrating a coupler in accordance with the present invention.

While this invention is susceptible of embodiment in many different forms, there is shown in the drawings and will hereinafter be described in detail a preferred embodiment of the invention, with the understanding that the present disclosure is to be considered as an exemplification of the principles of the invention and is not intended to limit the invention to the embodiment illustrated.

FIG. 1 illustrates a switch coupler 10 of the present invention installed in its optimum position between the last hose H in the line leading from a fire engine pumper (not shown) and the nozzle N. As will be described in greater detail below, the coupler includes a housing 12 formed of a suitable lightweight material such as aluminum. Housing 12 defines a longitudinal fluid flow chamber 14, FIG. 2, and includes coupling means 16 and 18 at the ends thereof, so that coupler 10 may be joined to hose H and nozzle N.

Rotatably mounted on housing 12 is a longitudinally extending, outer protective sleeve 20 which may be provided with grooves 20a or knurling to improve the gripping surface. Housing 12 includes a pair of longitudinally spaced-apart flanges 22 which support sleeve 20 and are maintained in sealing engagement therewith by rotating seals 24.

Positioned concentrically about housing 12 and beneath sleeve 20 are a battery pack 30, which provides power to an electronics package 32. Electronics package 32 includes a digital encoder, control and transmitter circuitry which generate a control signal in response to the hoseman signal, described below, and transmit it back to the fire engine pumper (not shown) through antenna 34. Antenna 34 is connected to package 32 by cable 36. The above-identified Nelson et al., application provides a complete disclosure of the circuitry contained in electronics package 32.

The electronics package is activated by two switches SW1 and SW2 which are embedded in or fastened to the forward end of encoder housing 40. Housing 40 is semi-circular segment shaped and may be formed of a suitable lightweight material such as nylon. Housing 40 is fixedly positioned to housing 12 by means of an electronics package clamp portion 42 and fasteners 44 which join the flats of housing 40 and portion 42. Alternately, electronics housings 40 and 42 may be formed as an integral part of main body housing 12.

Figure 3:
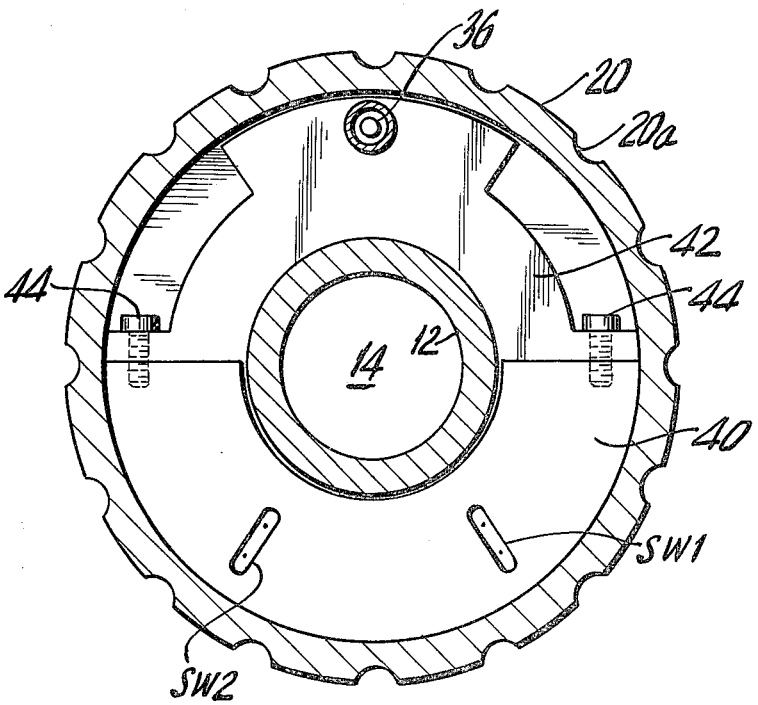
FIG. 3 is an enlarged sectional view taken along line 3—3 in FIG. 1, and illustrates the position of the reed switches.

Switches SW1 and SW2, FIG. 3, are preferably reed switches of the normally open type. Switches SW1 and SW2, when activated, provide a signal for increasing or decreasing fluid flow, respectively. Each reed switch is embedded in a radial orientation on a common radius and are displaced 35° from the vertical plane, as viewed in FIG. 3.

Figure 2:
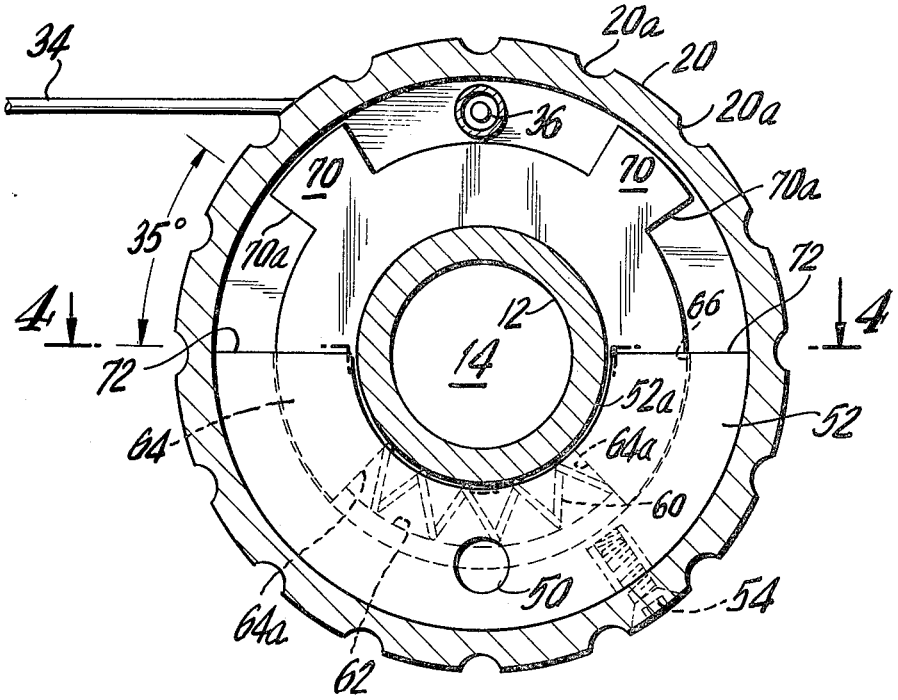
FIG. 2 is an enlarged sectional view taken along line 2—2 in FIG. 1.

FIG. 2 shows the actuating magnet 50 which is carried in a semi-circular, segment shaped, actuator block 52. Block 52 may be formed of nylon and is joined to sleeve 20 by a fastener 54 for conjoint rotation therewith. Magnet 50 is carried at a common radius with switches SW1 and SW2 in the face of block 52 adjacent the switches. As sleeve 20 is rotated manually by the hoseman, magnet 50 starts from a central position, as illustrated in FIG. 2, and travels in a path overlying the switches.

Figure 4:
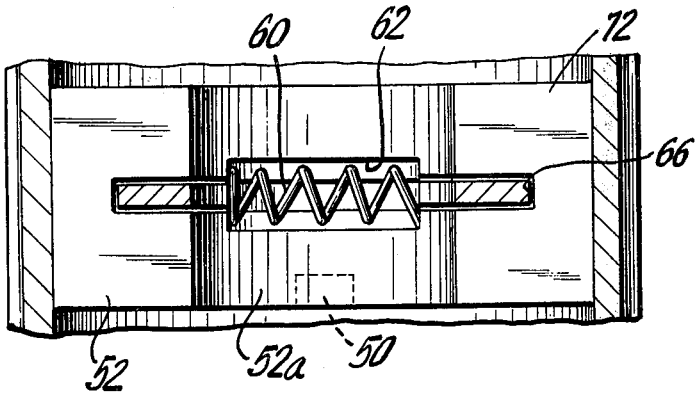
FIG. 4 is a top plan view taken in the direction 4—4 in FIG. 2, and illustrates the actuator member.

Actuator block 52 is maintained in a centered position by means of a compression spring 60, which is carried in a spring receiver 62 formed in the inner surface **52*a* of the block, FIG. 4. Housing 12 includes radially extending blade portions 64, the ends 64*a* of which are adapted to engage compression spring 60. To accommodate blade portions 64, actuator block 52 is provided with a U-shaped blade path 66 in which the blade portions may pass as the sleeve and actuator block are rotated. The blade portions and path bisect the spring receiver, FIG. 4, so that when the sleeve is in the equilibrium position, magnet 50 is in the position of FIG. 2. When the hoseman wishes to increase flow, he will rotate sleeve 20 in the clockwise direction, as viewed in FIG. 2, to cause magnet 50 to move into overlying relationship with switch SW1, as actuator 52 rotates clockwise, the left hand blade portion 64*a* will engage spring 60 and compress it within receiver 62**, so that, when the hoseman releases the sleeve, the actuator block and sleeve are returned to the centered position. To decrease the flow of fluid, the sleeve is merely rotated in the opposite direction.

As discussed above, switches SW1 and SW2 are angularly spaced 35° from the vertical. To assure that the magnet is positioned in registry with the reed switches, blade portions 64 include tabs 70. The leading radial edges 70*a* of tabs 70 are spaced 35° from the associated radial edges 72 of actuator block 52 in the centered position. In this manner, when the hoseman rotates sleeve 20, edges 72 will abut the associated edge 70*a* and act as a stop. Thus assuring that when the sleeve will rotate no further, magnet 50 is overlying the proper reed switch and actuation occurs.

As indicated above, the coupler 10 is positioned between the last hose and nozzle. This is the preferred location, however, it will be appreciated that the coupler could be positioned anywhere along the line. It will be also apparent that the coupler, although primarily designed for use in fire hoses may also be used in any fluid conduit system for remote control of fluid flow including such systems are spraying system and irrigating systems.

The rotary movement of the actuator lends itself to unimpeded operation and maneuverability. Human factor studies have shown that the optimum control motion of a gloved individual is rotary. Moreover, a rotary switch has the advantage that it cannot be accidently actuated by longitudinal forces on the hose.

The use of a reed switch, adapted to be operated by the movement of a magnet in the vicinity of the switch, is preferred since it allows for rather large design and assembly tolerances between the switch and switch actuator not permitted with other switch such as micro switches. Additionally, reed switches are self-contained, easy to maintain and are sealed against contamination.

From the above description it will be readily apparent that other modifications may be made to the present invention without departing from the scope and spirit of the invention as pointed out in the appended claims.

What is claimed is:

1. An electrical switch assembly for use in a fluid line having a hose and fluid dispensing device, which comprises: a housing defining a longitudinally extending fluid chamber, one end of said housing adapted to be coupled to said hose and the other end adapted to be coupled to said dispensing device; two reed switches adapted to be opened and closed by movement of a magnet in the vicinity thereof; means for mounting said reed switches in angularly spaced-apart relationship on said housing; manually graspable actuator means mounted for rotation about the longitudinal axis of said housing, said actuator means carrying a magnet for movement along a path overlying each of said reed switches; and biasing means for positioning said magnet at a central position in said path between said reed switches, whereby said magnet may be displaced by manual application of torque to the actuator means to energize the reed switch in the path of rotation and returned to said central position when said torque is released.

2. The assembly of claim 1, wherein said biasing means is a compression spring interposed between said housing and said actuator means.

3. The assembly of claim 1, further including means for generating an electrical command signal; and means for transmitting said command signal; each of said reed switches being electrically coupled to said command signal generating means to provide an input signal thereto.

4. An electrical switch assembly for use in a hose having a nozzle, which comprises: a housing defining a longitudinally extending fluid chamber and having a pair of radially extending blade portions thereon, said blade portions being angularly spaced apart, one end of said housing adapted to be coupled to said hose and the other end adapted to be coupled to said nozzle; two reed switches adapted to be opened and closed by movement of a magnet in the vicinity thereof; means for mounting said reed switches at a common radius on the housing and in angularly spaced-apart relationship; actuator means including a segment shaped member positioned for angular movement on said housing, said member defining a U-shape blade path extending about the inner face thereof and an inwardly opening spring receiving zone in the central portion of said blade path; a compression spring in said spring receiving zone and between said blade portions, said spring being adapted to be compressed by said blade portions when said member is rotated relative thereto; said member carrying a magnet in the surface thereof adjacent to and on a common radius with said reed switches, said magnet being positioned centrally between said reed switches; and a manually graspable sleeve rotatably mounted on said housing and operatively coupled to said segment shaped member, whereby, as said sleeve is rotated manually said magnet is displaced and energizes the reed switch in the direction of rotation, and said compression spring is compressed to return said actuator means to said centered position when the sleeve is released.

5. The assembly of claim 4, wherein said blade further includes a segment shaped tab portion extending radially therefrom, the radial edges of said member being adpated to engage the end of said tab to limit the angular displacement of said actuator means.

6. The assembly of claim 4, further including means for generating an electrical command signal; and means for transmitting said command signal; each of said reed switches being electrically coupled to said command signal generating means to provide an input signal thereto.

* * * * *